US007975339B2

(12) United States Patent
Gavney, Jr.

(10) Patent No.: US 7,975,339 B2
(45) Date of Patent: Jul. 12, 2011

(54) AQUATIC SCRUBBER

(76) Inventor: James A. Gavney, Jr., Palo Alto, CA (US)

( * ) Notice: Subject to any disclaimer, the term of this patent is extended or adjusted under 35 U.S.C. 154(b) by 843 days.

(21) Appl. No.: 10/895,750

(22) Filed: Jul. 20, 2004

(65) Prior Publication Data

US 2004/0255427 A1 Dec. 23, 2004

Related U.S. Application Data

(60) Continuation-in-part of application No. 10/640,767, filed on Aug. 13, 2003, now Pat. No. 6,820,300, which is a continuation of application No. 10/246,175, filed on Sep. 17, 2002, now Pat. No. 6,658,688, which is a division of application No. 09/906,230, filed on Jul. 17, 2001, now Pat. No. 6,463,619, which is a division of application No. 09/330,704, filed on Jun. 11, 1999, now Pat. No. 6,319,332.

(51) Int. Cl.
*A47L 9/06* (2006.01)
*A47L 13/12* (2006.01)
*E04H 4/16* (2006.01)

(52) U.S. Cl. ..... 15/1.7; 15/114; 15/117; 15/121; 15/401

(58) Field of Classification Search ..... 15/1.7, 15/114, 117, 401, 121
See application file for complete search history.

(56) References Cited

U.S. PATENT DOCUMENTS 620,151 A 3/1849 Emsa-Works et al.
116,030 A 6/1871 Devines
116,346 A 6/1871 O'Brian
218,431 A 8/1879 Dunham
411,910 A 10/1889 Van Horne
742,639 A 10/1903 Harlan
907,842 A 12/1908 Meuzies
915,251 A 3/1909 Vanderslice
1,006,630 A 10/1911 Clarke
1,021,010 A * 3/1912 Spencer ..... 15/399
1,128,139 A 2/1915 Hoffman
1,142,698 A 6/1915 Grove et al.
1,188,823 A 6/1916 Plank
1,191,556 A 7/1916 Blake
1,268,544 A 6/1918 Cates
1,278,222 A * 9/1918 Rudolph ..... 15/399
1,297,272 A 3/1919 Strang et al.
1,405,279 A 1/1922 Cassedy
1,526,267 A 2/1925 Dessau
1,578,074 A 3/1926 Chandler
1,588,785 A 6/1926 Van Sant
1,598,224 A 8/1926 Van Sant
290,515 A 5/1928 Voltz et al.
305,735 A 2/1929 Leeson et al.

(Continued)

FOREIGN PATENT DOCUMENTS

DE 31 14 507 A1 3/1983

(Continued)

*Primary Examiner* — Randall Chin
(74) *Attorney, Agent, or Firm* — James A. Gavney, Jr.; Jag Patent Services LLC

(57) ABSTRACT

A device with a squeegee configuration configured to clean or treat surfaces submersed in liquid is described. The squeegee configuration is preferably contoured to wipe contoured surfaces or flexible such as to conform to a variety of contoured surfaces. The squeegee configuration can be configured with bristles, a sponge or scouring elements. In further embodiments of the invention, the squeegee configuration is configured to draw a vacuum while wiping the surfaces.

10 Claims, 6 Drawing Sheets

U.S. PATENT DOCUMENTS

| | | | | | |
|---|---|---|---|---|---|
| 1,705,249 | A | | 3/1929 | Henry | |
| 1,707,118 | A | | 3/1929 | Goldberg | |
| 1,720,017 | A | | 7/1929 | Touchstone | |
| 1,833,555 | A | | 11/1931 | Bell et al. | |
| 1,852,480 | A | | 4/1932 | Ruetz | |
| 1,868,893 | A | | 7/1932 | Gentle | |
| 1,910,414 | A | | 5/1933 | Varga | |
| 1,924,152 | A | | 8/1933 | Coney et al. | |
| 1,965,009 | A | | 7/1934 | Stevens | |
| 1,993,662 | A | | 3/1935 | Green | |
| 2,059,914 | A | | 11/1936 | Rosenberg | |
| 2,088,839 | A | | 8/1937 | Coney et al. | |
| 2,117,174 | A | | 5/1938 | Jones | |
| 2,129,082 | A | | 9/1938 | Byrer | |
| 2,139,245 | A | | 12/1938 | Ogden | |
| 2,154,846 | A | | 4/1939 | Heymann et al. | |
| 2,219,753 | A | | 10/1940 | Seguin | |
| 2,226,145 | A | | 12/1940 | Smith | |
| 2,244,699 | A | | 6/1941 | Hosey | |
| 2,279,355 | A | | 4/1942 | Wilensky | |
| 2,280,751 | A | * | 4/1942 | Davis | 15/1.51 |
| 2,312,828 | A | | 3/1943 | Adamsson | |
| 2,334,796 | A | | 11/1943 | Steinmetz et al. | |
| 2,443,461 | A | | 6/1948 | Kempster | |
| 2,516,491 | A | | 7/1950 | Swastek | |
| 2,518,765 | A | | 8/1950 | Ecker | |
| 2,534,086 | A | | 12/1950 | Vosbikian et al. | |
| 2,545,814 | A | | 3/1951 | Kempster | |
| 2,637,870 | A | | 5/1953 | Cohen | |
| 2,678,458 | A | * | 5/1954 | Vosbikian et al. | 15/116.2 |
| 2,702,914 | A | | 3/1955 | Kittle et al. | |
| 2,739,327 | A | * | 3/1956 | Blair | 15/23 |
| 2,757,668 | A | | 8/1956 | Meyer-Saladin | |
| 2,793,385 | A | * | 5/1957 | Ortega | 15/367 |
| 2,815,601 | A | | 12/1957 | Hough, Jr. | |
| 2,819,482 | A | * | 1/1958 | Applegate | 15/110 |
| 2,893,044 | A | * | 7/1959 | Kurose | 15/322 |
| 3,008,160 | A | * | 11/1961 | West | 15/1.7 |
| 3,010,420 | A | * | 11/1961 | Glynn | 114/222 |
| 34,109 | A | | 1/1962 | Fenshaw et al. | |
| 3,069,716 | A | * | 12/1962 | Smith | 15/371 |
| 3,085,267 | A | * | 4/1963 | Jacuzzi | 15/1.7 |
| 3,103,027 | A | | 9/1963 | Birch | |
| 3,110,052 | A | | 11/1963 | Whitman | |
| 3,133,546 | A | | 5/1964 | Dent | |
| 3,181,193 | A | | 5/1965 | Nobles et al. | |
| 3,195,537 | A | | 7/1965 | Blasi | |
| 3,230,562 | A | | 1/1966 | Birch | |
| 3,231,925 | A | | 2/1966 | Conder | |
| 3,261,354 | A | | 7/1966 | Shpuntoff | |
| 3,273,187 | A | * | 9/1966 | Williams | 15/1.7 |
| D208,851 | S | * | 10/1967 | Lindberg | D32/33 |
| 3,359,588 | A | | 12/1967 | Kobler | |
| 3,491,396 | A | | 1/1970 | Eannarino et al. | |
| 3,553,759 | A | | 1/1971 | Kramer et al. | |
| 3,641,610 | A | | 2/1972 | Lewis, Jr. | |
| 3,707,737 | A | * | 1/1973 | Brower | 15/1.7 |
| 3,939,522 | A | | 2/1976 | Shimizu | |
| 3,969,783 | A | | 7/1976 | Shipman | |
| 3,977,084 | A | | 8/1976 | Sloan | |
| 3,992,747 | A | | 11/1976 | Hufton | |
| 4,115,893 | A | | 9/1978 | Nakata et al. | |
| 4,128,910 | A | | 12/1978 | Nakata et al. | |
| 4,167,794 | A | | 9/1979 | Pomeroy | |
| 4,277,862 | A | | 7/1981 | Weideman | |
| 4,407,213 | A | * | 10/1983 | Evans | 114/222 |
| 4,428,091 | A | | 1/1984 | Janssen | |
| 4,498,206 | A | * | 2/1985 | Braukmann | 15/1.7 |
| 4,573,920 | A | | 3/1986 | d'Argembeau | |
| 4,585,416 | A | | 4/1986 | DeNiro et al. | |
| 4,607,411 | A | * | 8/1986 | Lewis, Jr. | 15/117 |
| 4,610,043 | A | | 9/1986 | Vezjak | |
| 4,691,405 | A | | 9/1987 | Reed | |
| 4,763,380 | A | | 8/1988 | Sandvick | |
| 4,812,070 | A | | 3/1989 | Marty | |
| 4,827,551 | A | | 5/1989 | Maser et al. | |
| 4,866,806 | A | | 9/1989 | Bedford | |
| 4,929,180 | A | | 5/1990 | Moreschini | |
| 5,005,246 | A | | 4/1991 | Yen-Hui | |
| 5,032,082 | A | | 7/1991 | Herrera | |
| 5,040,260 | A | | 8/1991 | Michaels | |
| D326,019 | S | | 5/1992 | Spangler et al. | |
| 5,152,026 | A | * | 10/1992 | Scarpine | 15/1.7 |
| 5,211,494 | A | | 5/1993 | Baijnath | |
| 5,226,197 | A | | 7/1993 | Nack et al. | |
| 5,249,327 | A | | 10/1993 | Hing | |
| 5,283,921 | A | | 2/1994 | Ng | |
| 5,317,776 | A | * | 6/1994 | DeMoura | 15/1.7 |
| 5,335,389 | A | | 8/1994 | Curtis et al. | |
| 5,341,537 | A | | 8/1994 | Curtis et al. | |
| 5,386,607 | A | * | 2/1995 | Sebor | 15/1.7 |
| RE35,033 | E | * | 9/1995 | Waldhauser | 15/320 |
| 5,490,781 | A | * | 2/1996 | Wade | 433/116 |
| 5,491,863 | A | | 2/1996 | Dunn | |
| 5,528,793 | A | | 6/1996 | Schbot | |
| 5,535,474 | A | | 7/1996 | Salazar | |
| 5,547,376 | A | * | 8/1996 | Harrel | 433/116 |
| 5,584,690 | A | | 12/1996 | Maassarani | |
| 5,604,951 | A | | 2/1997 | Shipp | |
| 5,628,082 | A | | 5/1997 | Moskovich | |
| 5,669,097 | A | | 9/1997 | Klinkhammer | |
| 5,711,759 | A | | 1/1998 | Smith et al. | |
| 5,735,011 | A | | 4/1998 | Asher | |
| 5,799,353 | A | | 9/1998 | Oishi et al. | |
| 5,802,656 | A | | 9/1998 | Dawson et al. | |
| 5,806,127 | A | | 9/1998 | Samoil et al. | |
| 5,810,856 | A | | 9/1998 | Tveras | |
| D402,116 | S | | 12/1998 | Magloff et al. | |
| 5,850,669 | A | * | 12/1998 | Schupp et al. | 15/366 |
| D403,510 | S | | 1/1999 | Menke et al. | |
| 5,896,614 | A | | 4/1999 | Flewitt | |
| 5,930,860 | A | | 8/1999 | Shipp | |
| 5,966,771 | A | | 10/1999 | Stroud | |
| 5,970,564 | A | | 10/1999 | Inns et al. | |
| 5,980,542 | A | | 11/1999 | Saldivar | |
| 5,991,959 | A | | 11/1999 | Raven et al. | |
| 6,021,541 | A | | 2/2000 | Mori et al. | |
| 6,032,322 | A | | 3/2000 | Forsline | |
| 6,041,467 | A | | 3/2000 | Roberts et al. | |
| D422,143 | S | | 4/2000 | Beals et al. | |
| 6,044,514 | A | | 4/2000 | Kaneda et al. | |
| D424,808 | S | | 5/2000 | Beals et al. | |
| D425,306 | S | | 5/2000 | Beals et al. | |
| 6,065,890 | A | | 5/2000 | Weitz | |
| 6,067,684 | A | | 5/2000 | Kweon | |
| 6,077,360 | A | | 6/2000 | Takashima | |
| 6,088,869 | A | | 7/2000 | Kaneda et al. | |
| 6,099,309 | A | | 8/2000 | Cardarelli | |
| 6,108,854 | A | | 8/2000 | Dingert | |
| 6,115,871 | A | | 9/2000 | Royer | |
| 6,126,533 | A | | 10/2000 | Johnson et al. | |
| 6,151,745 | A | | 11/2000 | Roberts et al. | |
| 6,151,746 | A | | 11/2000 | Lewis, Jr. | |
| 6,168,434 | B1 | | 1/2001 | Bohm-Van Diggelen | |
| 6,182,323 | B1 | | 2/2001 | Bahten | |
| 6,182,365 | B1 | | 2/2001 | Tseng et al. | |
| 6,190,367 | B1 | | 2/2001 | Hall | |
| 6,219,874 | B1 | | 4/2001 | van Gelder et al. | |
| 6,240,590 | B1 | | 6/2001 | Nesbit | |
| 6,245,032 | B1 | | 6/2001 | Sauer et al. | |
| 6,254,390 | B1 | | 7/2001 | Wagner | |
| 6,272,713 | B1 | | 8/2001 | Lotwin | |
| 6,276,021 | B1 | | 8/2001 | Hohlbein | |
| 6,299,508 | B1 | | 10/2001 | Gagliardi et al. | |
| 6,311,360 | B1 | | 11/2001 | Lanvers | |
| 6,319,332 | B1 | | 11/2001 | Gavney, Jr. et al. | |
| 6,446,295 | B1 | | 9/2002 | Calabrese | |
| 6,463,619 | B2 | | 10/2002 | Gavney, Jr. | |
| 6,510,575 | B2 | | 1/2003 | Calabrese | |
| 6,513,182 | B1 | | 2/2003 | Calabrese et al. | |
| 6,571,417 | B1 | | 6/2003 | Gavney, Jr. et al. | |
| 6,647,585 | B1 | | 11/2003 | Robinson | |
| D483,184 | S | | 12/2003 | Geiberger et al. | |
| 6,658,688 | B2 | | 12/2003 | Gavney, Jr. | |
| 6,658,692 | B2 | | 12/2003 | Lenkiewicz et al. | |
| 6,668,418 | B2 | | 12/2003 | Bastien | |
| 6,725,493 | B2 | | 4/2004 | Calabrese et al. | |

| | | | | |
|---|---|---|---|---|
| 6,996,870 | B2 * | 2/2006 | Hohlbein | 15/110 |
| 2001/0039689 | A1 | 11/2001 | Gavney, Jr. | |
| 2002/0124337 | A1 | 9/2002 | Calabrese et al. | |
| 2003/0033680 | A1 | 2/2003 | Davies et al. | |
| 2003/0033682 | A1 | 2/2003 | Davies et al. | |
| 2003/0196283 | A1 | 10/2003 | Eliav et al. | |
| 2004/0010869 | A1 | 1/2004 | Fattori et al. | |
| 2004/0045105 | A1 | 3/2004 | Eliav et al. | |
| 2004/0060132 | A1 | 4/2004 | Gatzemeyer et al. | |
| 2004/0060133 | A1 | 4/2004 | Eliav et al. | |
| 2004/0060135 | A1 | 4/2004 | Gatzemeyer et al. | |
| 2004/0060136 | A1 | 4/2004 | Gatzemeyer et al. | |
| 2004/0060137 | A1 | 4/2004 | Eliav | |
| 2004/0154112 | A1 | 8/2004 | Braun et al. | |

FOREIGN PATENT DOCUMENTS

| | | | |
|---|---|---|---|
| DE | 298 16 488 | U1 | 1/1999 |
| DE | 199 57 639 | A1 | 6/2001 |
| FR | 2 636 818 | | 3/1990 |
| FR | 2 793 136 | | 11/2000 |
| GB | 2 040 161 | A | 8/1980 |
| JP | 9-140456 | | 3/1997 |
| WO | WO 96/28994 | | 9/1996 |
| WO | WO 96/20654 | | 11/1996 |
| WO | WO 98/22000 | | 5/1998 |
| WO | WO 98/18364 | | 7/1998 |
| WO | WO 01/01817 | A1 | 1/2001 |
| WO | WO 01/21036 | A1 | 3/2001 |

* cited by examiner

AQUATIC SCRUBBER

RELATED APPLICATIONS

This Application is a Continuation-in-Part Application of the application Ser. No. 10/640,767, entitled "Squeegee Device and System", filed Aug. 13, 2003, now U.S. Pat. No. 6,820,300 which is a Continuation Application of application Ser. No. 10/246,175, titled "Squeegee Device and System", filed Sep. 17, 2002, now U.S. Pat. No. 6,658,688 B2, which is a Divisional Application of application Ser. No. 09/906,230, entitled "Squeegee Device and System", filed Jul. 17, 2001, now U.S. Pat. No. 6,463,619 B2, which is a Divisional Application of application Ser. No. 09/330,704 also entitled "Squeegee Device and System" filed Jun. 11, 1999, now U.S. Pat. No. 6,319,332. The contents of U.S. Pat. Nos. 6,658,688 B2, 6,463,619 B2, 6,319,332, and the application Ser. No. 10/640,767, titled "Squeegee Device and System", now U.S. Pat. No. 6,319,300, are all hereby incorporated by reference.

FIELD OF THE INVENTION

This invention relates generally to cleaning devices and cleaning systems. More specifically, this invention relates to devices for cleaning surfaces in liquid or aquatic environments.

BACKGROUND

Treating surfaces is an activity that occupies a considerable portion of most peoples time. For example, household surfaces are regularly cleaned and polished and/or require the application of treatment or cleaning materials to the household surfaces. Also, many industrial processes, such as cleaning floors and polishing wafers, require contacting surfaces to clean the surfaces and/or apply materials to the surfaces. Likewise, pools, boats and/or vessels often require cleaning or treatment while their surfaces are submersed in a liquid. Accordingly, what is needed is a device and system that is capable of treating or cleaning the surfaces of boats, pools, or vessels while the surfaces are submersed or partially submersed in a liquid, such as water.

SUMMARY OF THE INVENTION

The invention is a device, system and method for treating a working surface. Preferably, the device includes a squeegee cleaning section that is configured to wipe contoured, rounded or angled surfaces of a pool, boat or other vessel while the surfaces are submersed or partially submersed in a liquid. The squeegee cleaning section can be contoured, rounded or angled to be complementary with or fit with the shape of the surface being treated. Alternatively, the squeegee cleaning section is malleable and configured to take on or conform to a variety of surface contours. Preferably, the squeegee cleaning section also includes bristles, an absorbent material, a scouring material and/or apertures, as described below. A number of squeegee configurations that include absorbent material, scouring material, and apertures are described in the U.S. patent application Ser. No. 10/705,150, filed Nov. 10, 2003, and titled "SQUEEGEE DEVICE AND SYSTEM," now abandoned , the contents of which are hereby incorporated by reference.

In accordance with the embodiments of the invention, a device is configured to apply a vacuum and/or deliver a liquid to working surface. The device of the instant invention has a squeegee configuration comprising one or more apertures.

The squeegee configuration comprises elongated squeegee walls that protrude from at least two locations. Preferably the one or more apertures are positioned between the elongated squeegee walls such that the vacuum or liquid is delivered to the working surface between the elongated squeegee walls. The squeegee configuration is preferably configured to couple to a source for providing the vacuum or liquid to the working surface through the one or more apertures.

In still further embodiments of the invention, one or more of the regions of the cleaning head comprises nodules, i.e resilient protrusions with any number of different geometries such as described below and further described in U.S. patent application Ser. No. 09/957,302, filed Sep. 19, 2001 and titled "DEVICE WITH MULTI-STRUCTURAL CONTACT ELEMENTS," now U.S. Pat. No. 6,865,767 the contents of which are hereby incorporated by reference.

The squeegee elements utilized in the present invention can have any number of different geometries including curved, rounded angled, corrugated, pointed and/or textured walls and/or wiping edges. Squeegee elements can include squeegee segments with one or more terminus ends and/or squeegee segments that form matrices of squeegee compartments and continuous squeegee segments that encircle portions or regions of a support surface. Squeegees utilized in the present invention can be formed from any number of different materials, but are preferably formed from a resilient polymeric material such as silicon, latex, rubber, polyurethane or a combination thereof. Preferably, squeegees, or a portion thereof, are formed from a material, or materials, that can be molded and that result in squeegee elements with hardness values in a range of 10 to 100 Shores A, as defined in the D2240-00 Standard Test Method for Rubber Property-Duromter Hardness, published by the American Society for Testing Materials, the contents of which are hereby incorporated by reference. Additional details of squeegee configurations are provided in the U.S. Pat. No. 6,319,332, filed Jun. 11, 1999, titled "SQUEEGEE DEVICE AND SYSTEM," and U.S. Pat. No. 6,571,417, filed Jun. 5, 2000, titled "DENTITION CLEANING DEVICE AND SYSTEM," the contents of which are also both hereby incorporated by reference.

Squeegees, in accordance with still further embodiments of the present invention, include an abrasive material that is integrated with the material(s) used to form the squeegees and/or are applied to surfaces of squeegee walls and/or edges after they are formed. Methods and materials for making molded abrasive structures are described in U.S. Pat. No. 6,126,533, titled "MOLDED ABRASIVE BRUSH", the contents of which are hereby incorporated by reference.

In accordance with still further embodiments of the invention, a squeegee element comprises an elongated squeegee segment with smaller fins that protrude from walls of the elongated squeegee segment and provide top wiping edges and side wiping edges, such as described in detail in U.S. patent application Ser. No. 10/454,281, filed Jun. 3, 2003, titled "MULTI-DIRECTIONAL WIPING ELEMENTS AND DEVICES USING THE SAME", now U.S. Pat. No. 6,859,969 the contents of which are hereby incorporated by reference.

The squeegee configuration comprises any number of simple or complex arrangements of squeegee segments or members including groupings of linear or curved squeegee segments, continuous squeegees, spiral squeegee , matrices or arrays of squeegees, or any combination thereof.

A system, in accordance with the embodiments of the invention, comprises a vacuum source, a liquid source and an applicator head. The applicator head comprises a squeegee configuration with apertures. A first portion of the apertures are configured to couple to the vacuum source and draw a vacuum on a working surface and a second portion of the apertures are configured to couple to the liquid source and deliver a liquid to the working surface. The applicator head can also comprise bristles and/or a scouring or abrasive element. In accordance with a preferred embodiment of the invention, the squeegee configuration comprises one or more curved squeegee segments, such as a spiraling squeegee element, and is configured to rotate and/or otherwise move while in contact with the working surface. The current invention is particularly well suited for cleaning surfaces of pools, boats or vessels that have surfaces that are submersed or partially submersed in liquid.

DETAILED DESCRIPTION OF THE INVENTION

Figure 1A:
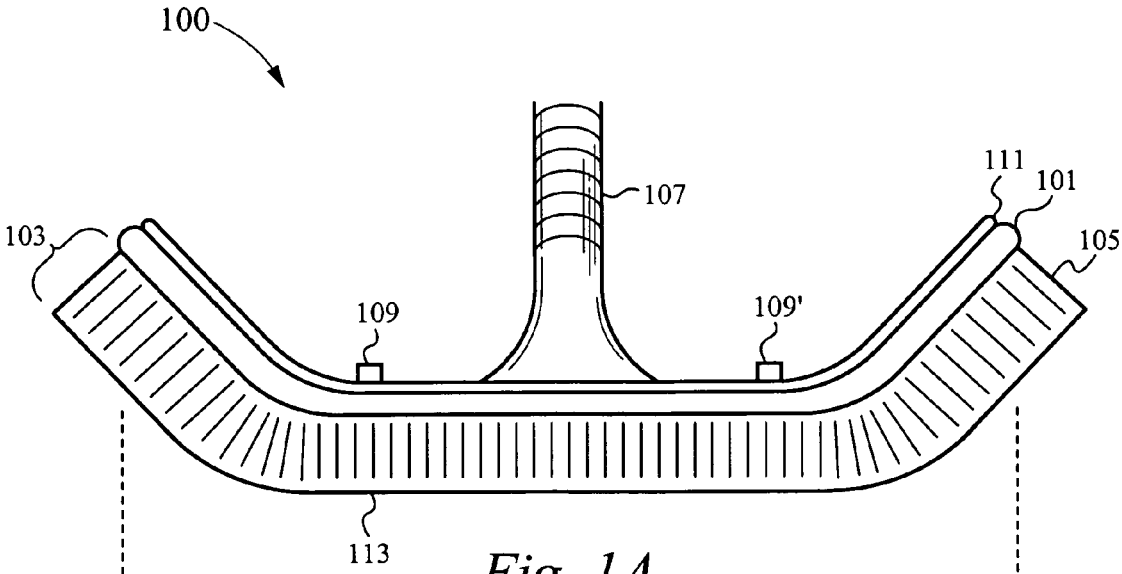
FIGS. 1A-B show a scrubber device with a cleaning section comprising a squeegee and bristles coupled to a contoured support structure, in accordance with the embodiments of the invention.
Figure 1B:
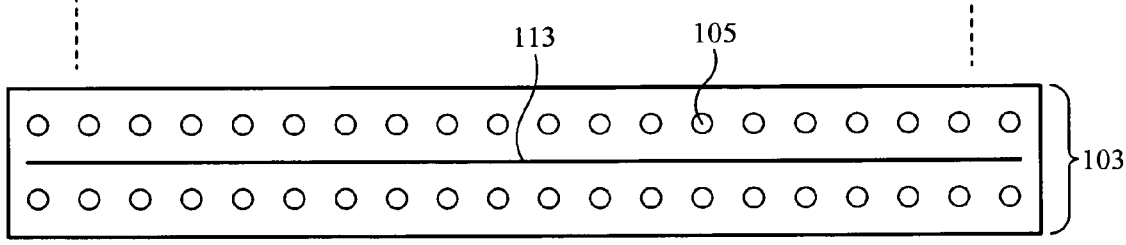

FIGS. 1A-B show a side view and a bottom view of a cleaning head 100, in accordance with the embodiments of the invention. The cleaning head 100 comprises a squeegee configuration 103 that includes bristles 105 and a squeegee 113 that protrude from a support surface 101. The support surface 101 can be rigid or flexible and formed from any material or materials suitable for the application at hand. The squeegee 113 is shown as a linear squeegee, but can have any number of different shapes, as described above and further described below. The squeegee 113 can be flanked on one side or both sides by the bristles 105, as shown. The squeegee preferably has a contoured wiping edge for contacting contoured surfaces, such as a wall of a swimming pool.

Still referring to FIGS. 1A-B, the cleaning head 100 can include a support structure 111 that is configured to couple to the support surface 101. The support surface 101 of the squeegee can couple to the support structure 111 through any number of means including fitted features, such as matched or complementary channels and grooves that allow the support surface 101 to securely slide or fit onto the support structure 111. Alternatively, or in addition to the fitted features, the support surface 101 of the squeegee configuration 103 can be configured to be secured to the support structure 111 through screws or lock features 109 and 109'. The cleaning head 100 can also include a mounting feature 107 for coupling the cleaning head 100 to an elongated handle (not shown).

Figure 2A:
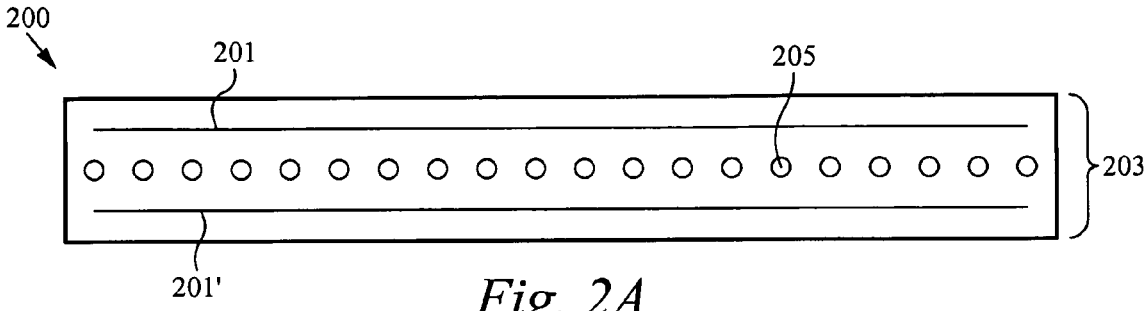
FIGS. 2A-E show cleaning sections with squeegees and bristles, in accordance with the embodiments of the invention.
Figure 2B:
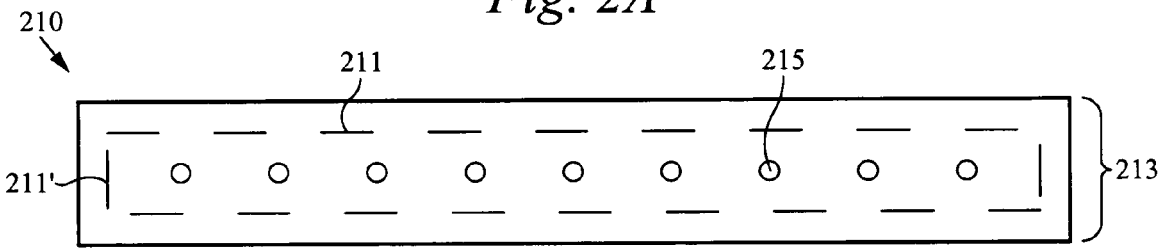
Figure 2C:
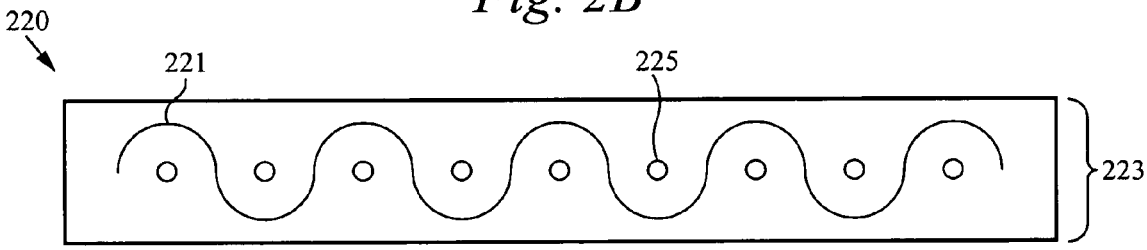

FIGS. 2A-E show bottom views of cleaning heads 200, 210, 220, 230 and 240 with squeegee configurations 203, 213, 223, 233, and 243, respectively, in accordance with the embodiments of the invention. FIG. 2A shows the bottom view of the cleaning head 200 comprising the squeegee configuration 203 comprising linear squeegee segments 201 and 201' that flank a row of bristle 205. FIG. 2B shows a bottom view of the cleaning head 210 with the squeegee configuration 213 comprising squeegee segments 211 and 211' that extend in a plurality of directions and that surround a row of bristles 215. FIG. 2C shows the bottom view of the cleaning head 220 with the squeegee configuration 223 comprising a serpentine or wave-like squeegee 221 curving around bristles 225.

Figure 2D:
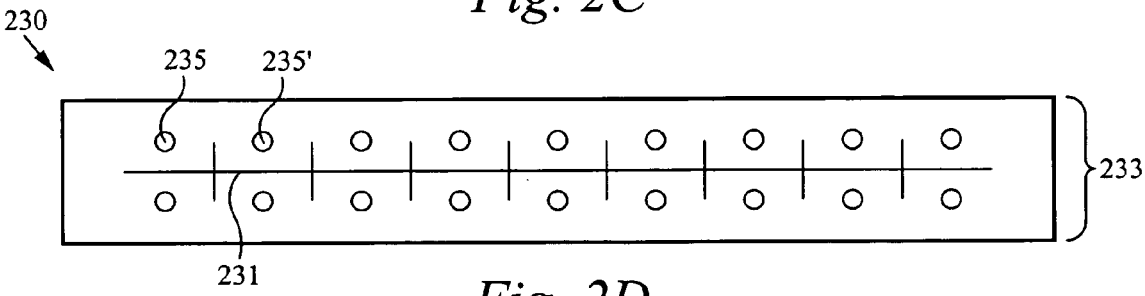
Figure 2E:
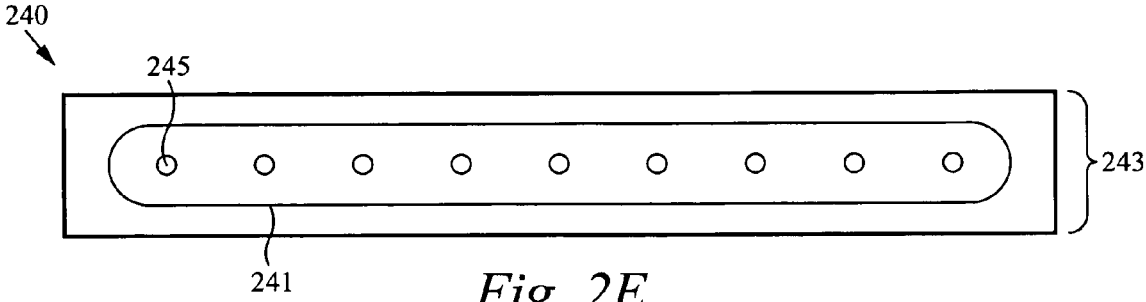

FIG. 2D shows a bottom view of the cleaning head 230 with a squeegee configuration 233 comprising a fish bone shaped squeegee 231, also described as an elongated squeegee with a plurality of intersecting squeegee segments. The squeegee configuration 233 also preferably includes bristles 235 and 235' that surround portions of the fish-bone shaped squeegee 231. FIG. 2E shows a bottom view of the cleaning head 240 with a squeegee configuration 243 comprising a continuous squeegee 241 that encircles bristles 245. Preferably, the squeegees described above with reference to FIGS. 2A-E have contoured wiping edges and/or are configured to be flexible so that they can conform to a variety of contoured surfaces.

Figure 3A:
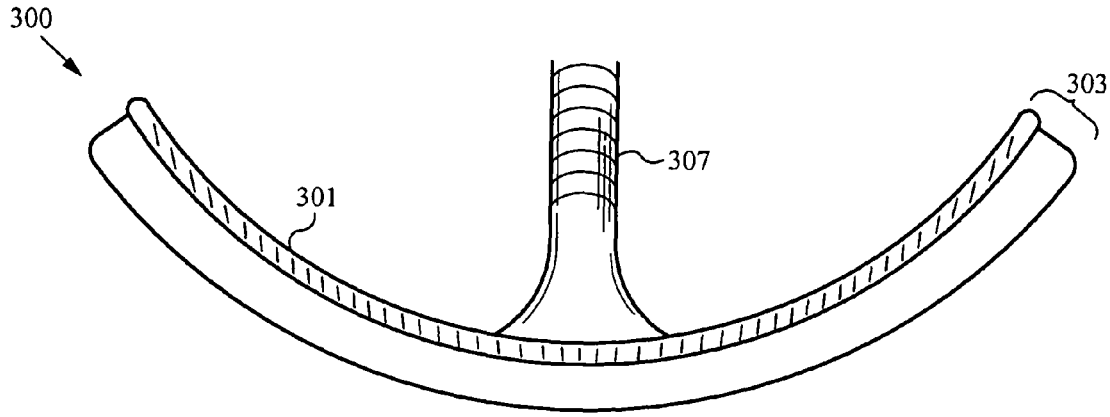
FIGS. 3A-C show devices with contoured cleaning sections, in accordance with the embodiments of the invention.
Figure 3B:
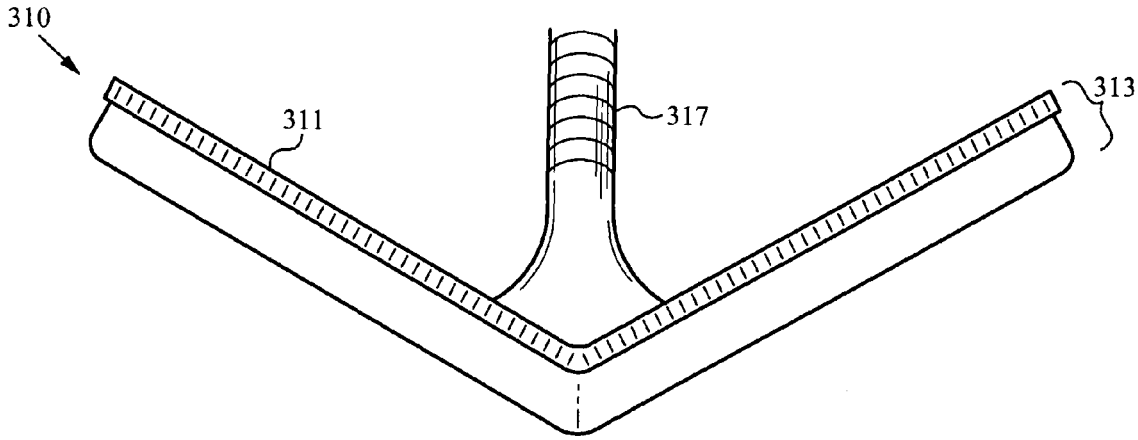
Figure 3C:
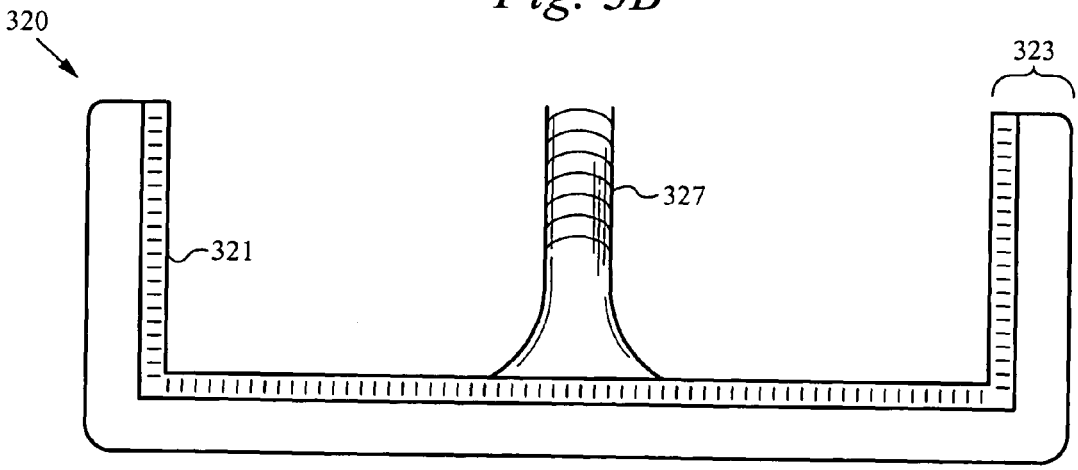

FIGS. 3A-C show side views of cleaning heads 300, 310 and 320. The cleaning heads 300, 310 and 320 comprises squeegee configurations 303, 313 and 323, respectively, such as described with reference to FIGS. 1A-B and FIGS. 2A-E. The squeegee configurations 303, 313, and 323 preferably comprise contoured support surfaces that are rounded 301, angled 311 or bent 321. The contoured support surfaces 301, 311 and 321 can be rigid or flexible and formed from any number of suitable materials including, but not limited to, metal, plastic and rubber. The cleaning heads 300, 310 and 320 can also include mounting features 307, 317 and 327, respectively, for coupling the cleaning heads 300, 310 and 320 to a handle.

Figure 4A:
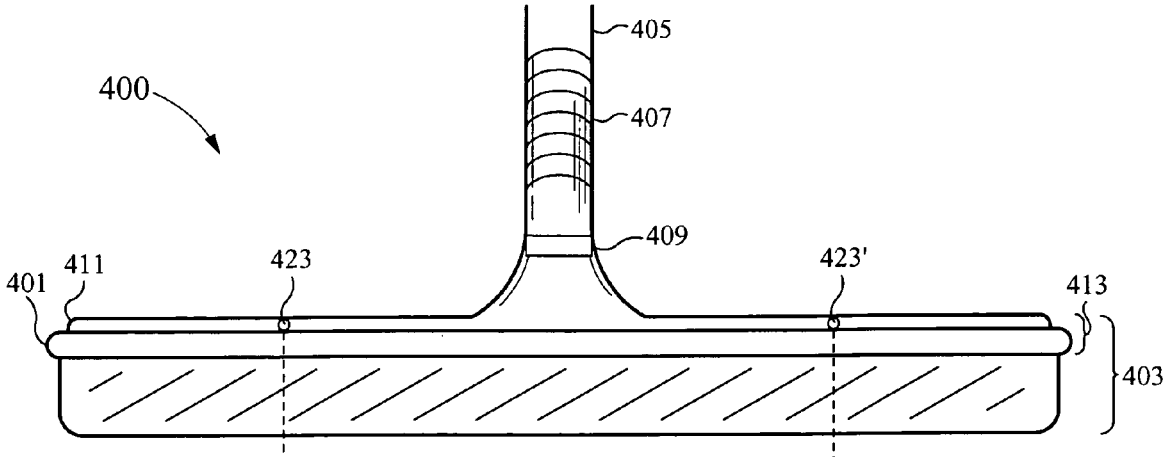
FIGS. 4A-C show a device with a flexible or bendable cleaning section that is adaptable to a range of surface contours, in accordance with the embodiments of the invention.
Figure 4B:
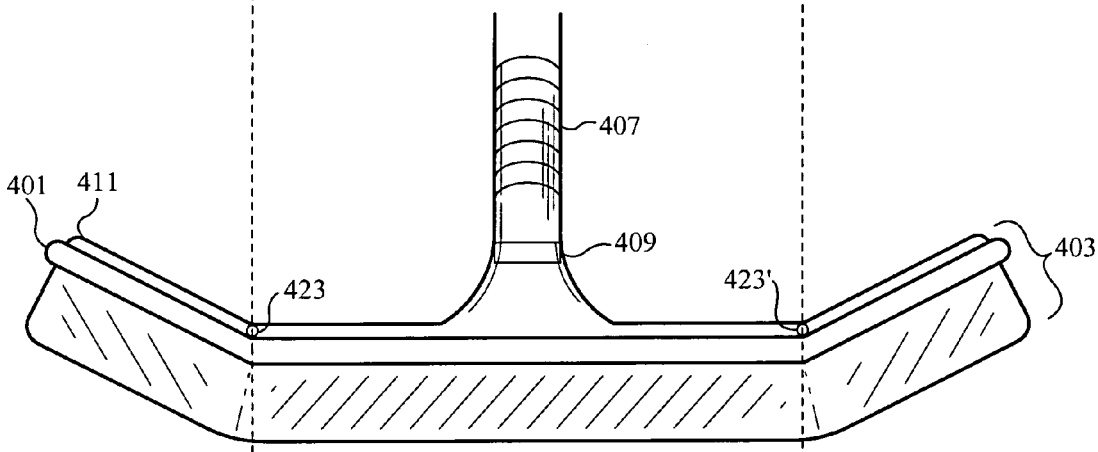
Figure 4C:
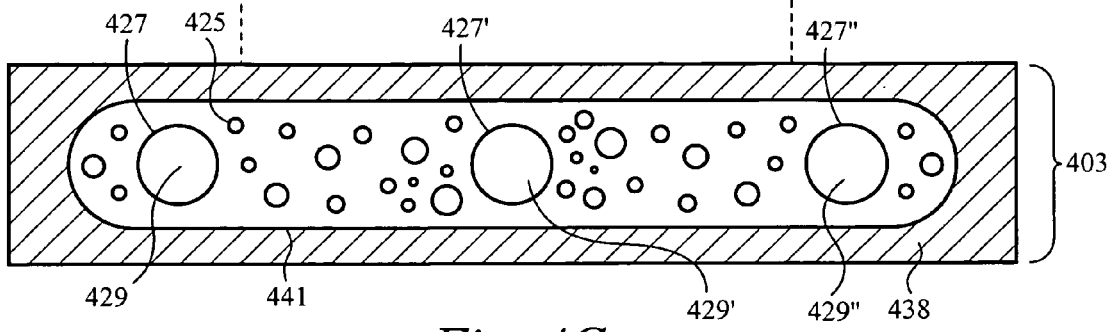

FIGS. 4A-C illustrate a cleaning head 400, in accordance with further embodiments of the invention. The cleaning head 400 comprises a squeegee configuration 403, such as described with reference to FIGS. 1A-B and FIGS. 2A-E. The squeegee configuration 403 comprises a flexible structure 413 coupled to a handle 405 through a mounting feature 407. The mounting feature 407 can be hingably or flexibly coupled to the rest of the cleaning head 400 through a hinge element 409, such that the cleaning head 400 can be angled or swiveled relative to the handle 405.

The flexible structure 413 can include a flexible support surface 401 that is sectionalized, hinged and/or otherwise deformable. The flexible support surface 401 can be configured to be mountable or attachable to a flexible support structure 411. The flexible support structure 411 is, in accordance with the embodiments of the invention, articulated, jointed or hinged through hinge elements 423 and 423' such that the squeegee configuration 403 can bend or contour to a variety of contoured surfaces, such as illustrated in FIG. 4B.

FIG. 4C shows bottom view of a squeegee configuration 403 in accordance with the embodiments of the invention. The squeegee configuration 403 can comprise a continuous squeegee element 441 and one or more apertures 429, 429' and 429" for drawing a vacuum while wiping a surface with the squeegee configuration 403. The continuous squeegee element 441 helps to establish or maintain suction on the surface. The squeegee configuration 403 comprise any other squeegee element or combination of squeegee elements, including continuous squeegee elements 427, 427' and 427" that encircle the apertures 429, 429' and 429", or other squeegee elements, such as described above with reference to FIGS. 1 A-B and FIGS. 2A-E. The squeegee configuration 403 can also include bristles 438, a sponge section, 425, a scouring section and combinations thereof.

Figure 5:
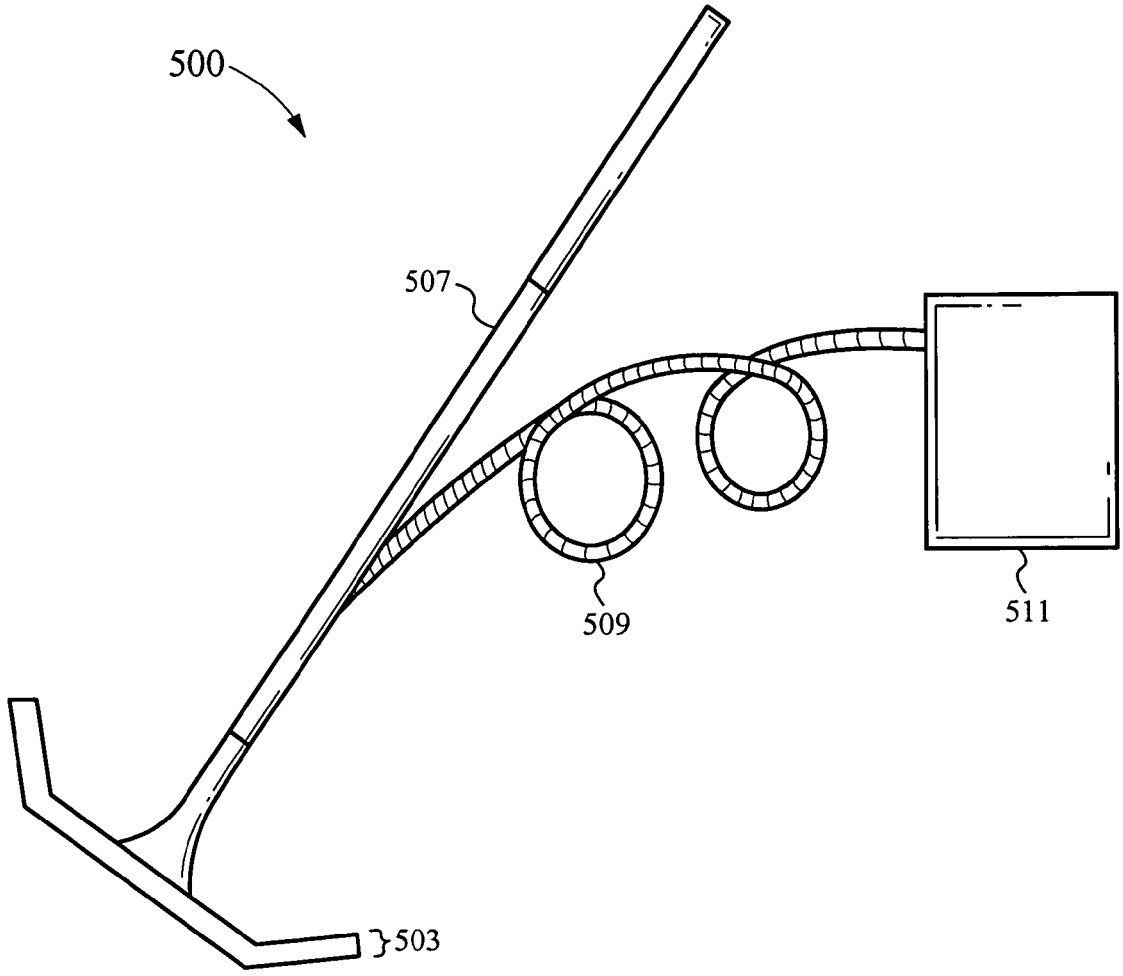
FIG. 5 shows a system with a squeegee cleaning section and a vacuum, in accordance with further embodiments of the invention.

FIG. 5 shows a system 500, in accordance with the embodiments of the invention. The system 500 comprises a handle 507 that can telescope and/or is hingably attached to a cleaning head 503 with a squeegee configuration, such as described above. The cleaning head 503 preferably includes a squeegee configuration that is contoured or is capable of being contoured. The cleaning head 503 is preferably coupled to vacuum source 511 through a hose 509 and is configured to draw a vacuum through the cleaning head 503 while wiping a surface.

Figure 6:
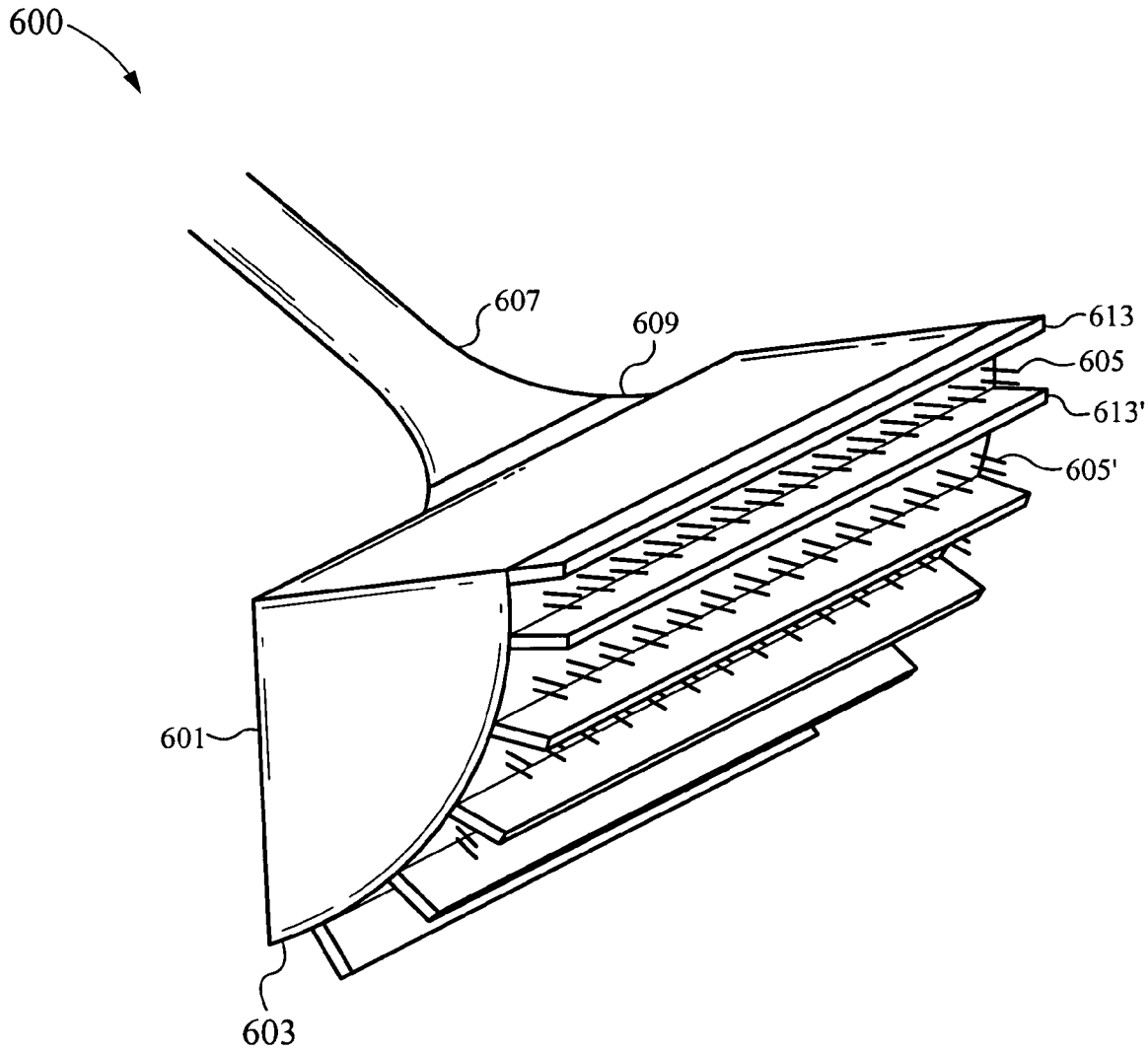
FIG. 6 shows a cleaning head with a contoured cleaning section, in accordance with an alternative embodiment of the invention.

FIG. 6 shows a cleaning head 600, in accordance with yet further embodiments of the invention. The cleaning head 600 comprises a contoured or curved support 601 with a contoured or curved surface 603. A plurality of squeegee segments 613 and 613' protrude from the contoured or curved support surface 603. Interposed between the squeegee segments 613 and 613' are bristles 605 and 605' protruding from the contoured or curved support surface 603. The wiping edges of the squeegee segments 613 and 613' and the tips of the bristles 605 and 605' preferably fan out from the contoured or curved support surface 603, such that flat and contoured or curved surfaces can be treated or wiped with the cleaning head 600. The cleaning head 600 can also include a mounting feature 607 for coupling or connecting to a handle. The mounting feature can attach to the support structure 601 through a hinge feature 609, such as described above with reference to FIGS. 4A-C.

It will be clear to one skilled in the art from the description above that top wiping edges and side wiping edges of the squeegee element and segments described can be contoured, corrugated, curved, pointed, angled, tapered or otherwise textured. While embodiments have been described with bristles, bristles are not required. Further, any number of the features described above can be combined in different ways to provide other squeegee configurations that are considered to be within the scope of the invention. It is also understood that an abrasive material can be integral with the squeegee segments or attached to the walls or edges of squeegees as required for the application at hand. Further, the absorbent elements utilized in the squeegee configurations can be formed from synthetic materials, such as polyurethane, plastics, rubber, other polymeric materials, natural materials, such as natural sponge, woven materials, such as cotton and/or other woven materials. The scouring or abrasive elements utilized in the squeegee configuration can be formed from metal, plastic, composite materials or any combination thereof. Also, walls of squeegee segments, while generally shown as uniform herein, can vary in thickness in either an elongated direction, in a protruding direction or both. Accordingly, the preceding preferred embodiments of the invention are set forth without any loss of generality to, and without imposing limitations upon, the claimed invention as defined by the following claims.

What is claimed is:

1. A device comprising an elongated cleaning head, the elongated cleaning head comprising:

a) a flexible elongated support surface;

b) at least one first resilient squeegee with contoured wiping edges protruding from the flexible elongated support surface and surrounding an inner squeegee region;

c) bristles that surround the at least one first resilient squeegee and the inner squeegee region;

d) one or more apertures surrounded by at least one resilient second squeegee, wherein the one or more apertures surrounded by the at least one resilient second squeegee are on the flexible elongated support surface and within the inner squeegee region, and wherein the one or more apertures are configured to draw a vacuum through; and e) an absorbent element and a scouring element protruding from the flexible elongated support surface and from within the inner squeegee region.

2. The device of claim 1, wherein the one first squeegee includes a curved squeegee.

3. A device comprising:

a) an elongated flexible support structure;

b) a flexible surface that detachably couples along the length of the elongated flexible support structure, wherein the flexible surface is parallel to the flexible support structure;

c) at least one squeegee protruding from the flexible surface;

bristles protruding from the flexible surface and surrounding the at least one squeegee, wherein the bristles protrude in a direction substantially the same as that of the least one squeegee, such that the at least one squeegee and the bristles are configured to simultaneously treat a working surface; and d) an absorbent element and a scouring element protruding from the flexible surface.

4. The device of claim 3, wherein the elongated flexible support structure is contoured.

5. The device of claim 3, further comprising an elongated handle coupled to the elongated flexible support structure.

6. A system comprising:

a) an elongated cleaning head comprising;

I) an articulated support surface;

ii) a squeegee cleaning section coupled to the articulated support surface, wherein the length of the squeegee cleaning section is coupled along the length of the articulated support surface and wherein the squeegee cleaning section comprises a squeegee and bristles surrounding the squeegee; and iii) an absorbent element and a scouring element protruding from the articulated support surface; and b) a vacuum means for drawing a vacuum through the elongated cleaning head.

7. The system of claim 6, wherein the vacuum means comprises a vacuum source coupled to the cleaning head through a hose structure.

8. The system of claim 6, further comprising a handle configured to couple to the cleaning head.

9. The system of claim 8, wherein the handle is extendable.

10. The system of claim 8, wherein the cleaning head is hingeably attached to the handle.

* * * * *